United States Patent [19]

Koren et al.

[11] 4,397,516

[45] Aug. 9, 1983

[54] CABLE TERMINATION APPARATUS

[75] Inventors: David H. Koren, Sidney; Allan B. Kirby, Sidney Center; Donald H. Gould, Sidney, all of N.Y.

[73] Assignee: The Bendix Corporation, Southfield, Mich.

[21] Appl. No.: 267,159

[22] Filed: May 26, 1981

[51] Int. Cl.[3] ..... H01R 17/08

[52] U.S. Cl. ..... 339/177 R

[58] Field of Search ..... 339/177 R, 177 E

[56] References Cited

U.S. PATENT DOCUMENTS

| | | | |
|---|---|---|---|
| 3,103,548 | 9/1963 | Concelman | 339/177 R X |
| 3,150,231 | 9/1964 | Clark . | |
| 3,295,095 | 12/1966 | Kraus | 339/177 R |
| 3,324,228 | 6/1967 | Larsson . | |
| 3,526,871 | 9/1970 | Hobart | 339/177 E |
| 3,634,815 | 1/1971 | Stevens et al. | 339/177 E |
| 3,670,293 | 6/1972 | Garver . | |
| 4,307,926 | 12/1981 | Smith | 339/177 R |

OTHER PUBLICATIONS

Dage, Engr. Specification Hurricane Rd., Franklin, Ind., Des. #339, "Assembly for BNC Triax to Twinax Cable, RG-108AU," 6, 1967.

*Primary Examiner*—Howard Goldberg

*Attorney, Agent, or Firm*—Charles D. Lacina; Raymond J. Eifler

[57] ABSTRACT

A cable termination apparatus (90) for use in locating and terminating an electrical cable (10) of the twin-axial type to an electrical connector (50), the cable having a pair of insulated wires (20,30) having inner conductors (22, 32), the apparatus being characterized by as comprising a body (91) of conductive material including a passage (95) for receiving and locating one of the wires (30) and a radial slot (96) for receiving and locating the inner conductor (22) of the other wire (20), the passage (95) extending through the body and having a generally frusto-conical wire entry portion, (97) the slot (96) extending axially inward from one end of the body and intersecting with the frusto-conical portion (97) to provide stress relief to the conductor (22) when terminated within the slot (96) by solder (98).

4 Claims, 5 Drawing Figures

110
111
112
120
121
130
131
140
141
144
146
154
156
158
162
172
190
196
90
91
92
93
94
95
96
97
40
50
50a
52
52a
54
54a
56
56a
58
58a
60
62
62a
64
66
67
70
72
74
76
77
78
80
81
82
83
84
85
86
87
90

CABLE TERMINATION APPARATUS

This invention relates to radio frequency applications wherein a pair of insulated electrical conductors of a twinaxial type cable are terminated in a connector member and more particularly to an apparatus for locating the ends of the electrical conductors for termination to and electrical interconnection with conductive contact terminals of the connector member.

In some applications, a user wishes to electrically interconnect devices for the purpose of transmitting signals. To achieve this, a separate pair of individual coaxial cables could be used. However the use of separated coaxial cables is not always desirable because separated cables may result in an electrically imbalanced system. More desirably, a twinaxial cable is used. A twinaxial cable is available in the industry and comprises a pair of insulated conductor wires enclosed by a single sheath of conductive braid and an outer protective jacket. The twinaxial cable is terminated to a triaxial connector which is characterized by a pair of coaxial contacts and a coaxial connector shell.

One termination of the twinaxial cable in the past has required suitable preparation of the cable end which included exposing unequal axial extensions of each wire and respective conductor end and terminating the conductive extensions, the longer conductive extension being wrapped around and soldered to a coaxial conductive contact to complete one termination. Each of the conductor ends, when terminated to the coaxial conductive contact, provided a contact subassembly for a connector body.

This termination has been difficult to accomplish in that the conductive extension of one wire must be wrapped about the conductive contact and soldered thereto. An assembler cannot be assured that the solder has firmly terminated the conductor wire to the terminal. Also since the conductive contact was free to rotate in the connector body during assembly therewith, the soldered connection could break or be damaged thereby affecting the quality of signal transmission or impairing electrical continuity. A soldered termination should not be designed to withstand mechanical loads.

Twinaxial cable construction is such that the closer that the wires and cable can be kept in condition as supplied, the better the termination (i.e., keeping the wires parallel reduces loads placed on the termination).

A more desirable termination would provide an arrangement of connector parts capable of reconciling conflicting electrical and mechanical requirements of such connectors by providing (a) improved and stabilized electrical continuity, yet with (b) increased mechanical strength, and particularly (c) characterized by simplified installation procedures but yet so designed and constructed as to be well suited to commercially practicable methods of manufacture and adapted to production at a cost competitive with the cost of prior types of connectors lacking the advantageous features hereinafter disclosed.

DISCLOSURE OF THE INVENTION

The invention is a cable termination apparatus for use in locating and terminating an electrical cable of the twinaxial type with an electrical connector, the cable of the type including a pair of insulated wires having inner conductors, the wires being surrounded in common first by a braid-type outer conductor and second by an exterior protection jacket. The apparatus is secured within the connector and is characterized as a locator member comprised of conductive material having axially spaced forward and rearward faces and an outer surface, the locator including a passage of generally uniform diameter which extends between the faces and sized to pass one of the insulated wires and a slot sized to receive the conductor of the other wire, the slot being axially extending and radially directed into the outer surface, the passage having a generally frustoconical tapering portion extending from the inner portion of the body to the rear face and intersecting the slot, the connector including securing means for holding the conductors and the locator in axially fixed positions relative to one another.

An advantage of the present invention is provision of an improved termination between a suitably prepared end portion of twinaxial cable and a triaxial connector wherein a locator member permits rapid straight-in axial insertion of the cable and allows easier soldering and terminating of the conductors with contacts of the connector.

Another advantage of the invention is provision of a simple yet improved electrical connection between a pair of conductors in a twinaxial transmission line and their contacts in a connector housing, whereby the mechanical weaknesses characterizing many prior types of twinaxial radio frequency connections are to a large extent avoided.

Another advantage of the present invention is that the axes of each of the wires (and their associated conductors) are maintained in substantially parallel relation.

A still further advantage of the invention is to provide an improved triaxial connector having the mechanical and electrical features noted above, yet so designed as to be suited to pre-assembly of the principle component parts of the assembly, whereby it is capable of quick, easy and convenient attachment to the twinaxial lines.

The manner in which the present invention achieves the foregoing advantages is best described in connection with the following drawings attached herewith and forming a part of the present specification, wherein.

Figures 1, 3, 4:
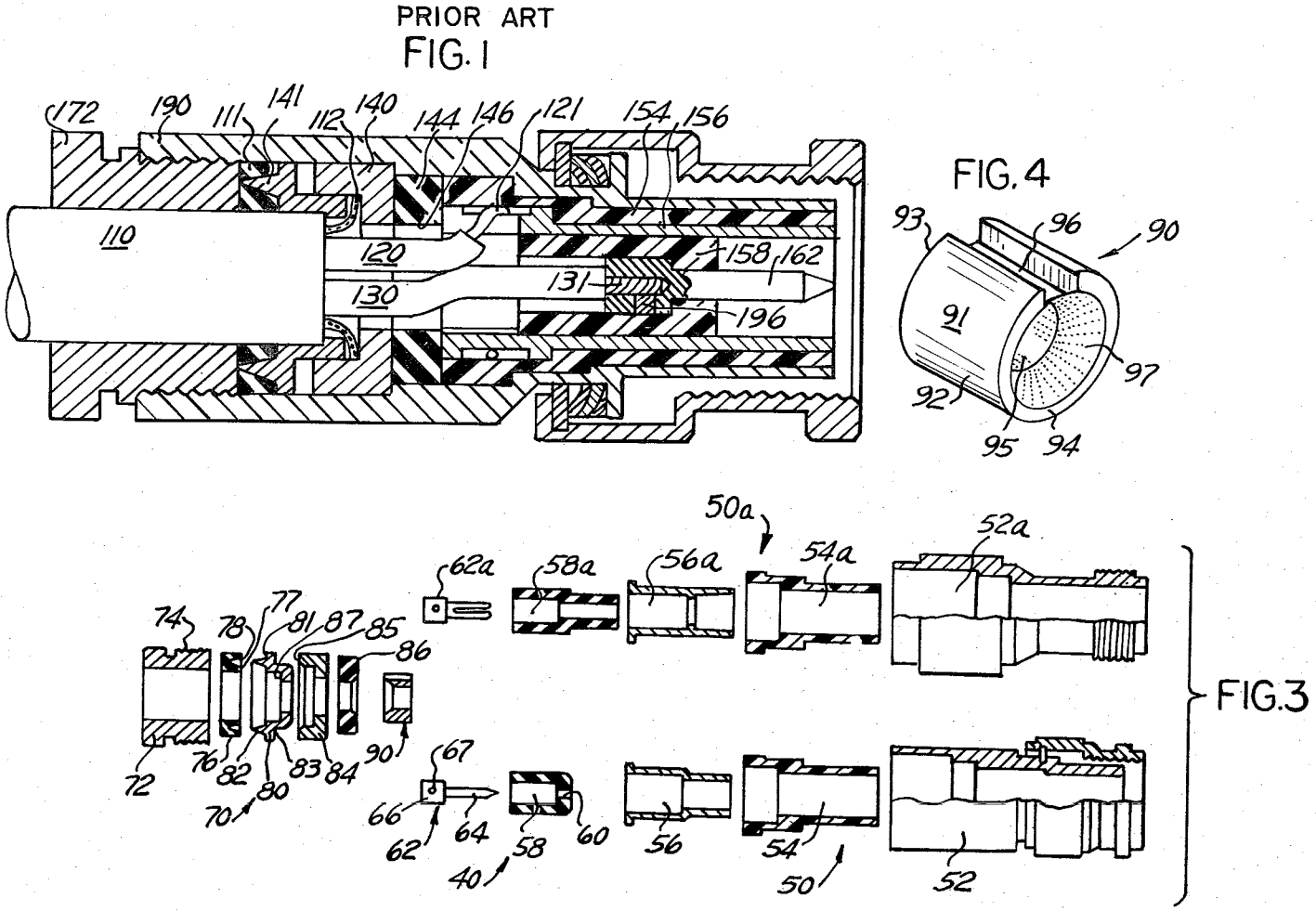
PRIOR ART FIG. 1
FIG. 1 is a prior art assembly between a twinaxial cable and a triaxial connector.
FIG. 3 is an exploded view in section of the connector assembly of the present invention.
FIG. 4 is a perspective view of a conductor locator according to the present invention.

Turning first to FIG. 1 is shown a prior art termination between a twinaxial cable 110 and a connector. The cable is stripped on the end portion such that cable braid 112 thereof is exposed and insulated conductor wires 120, 130 extend from the cable with unequal axial extensions. The termination includes assembly of a nut 172 of conductive material, a gasket 111 of resilient insulative material and a clamp 141 of conductive material. Less insulation is then removed from an end portion of the longer wire 130 than from an end portion of the shorter wire 120 to thereby expose their inner conductors 121, 131. A second conductive clamp 140 is arranged about the other clamp 141 to secure the cable braid 112 relative to the wires 120, 130. An insulator sleeve 144 having a central aperture 146 is positioned forward of the clamp arrangement such that the two wires pass therethrough, the shortest conductor 131 being terminated by solder 196 to a center contact 162. A second insulator sleeve 158, a conductive intermediate contact 156 and a third insulator sleeve 154 is slid over the center contact 162 and positioned against the first insulator sleeve 144. Conductor 121 is wrapped around the exterior of intermediate contact 156 and soldered thereto. This subassembly fits into an outer connector body 190 of conductive material. The nut 172 fastens the assembly into place within connector body 190. Those in the art found that wrapping and soldering the long exposed conductor 121 to the contact 156 was unacceptable since the subassembly could rotate during the assembly and the soldered joint was thus prone to cracking and/or snap-off.

Figure 2:
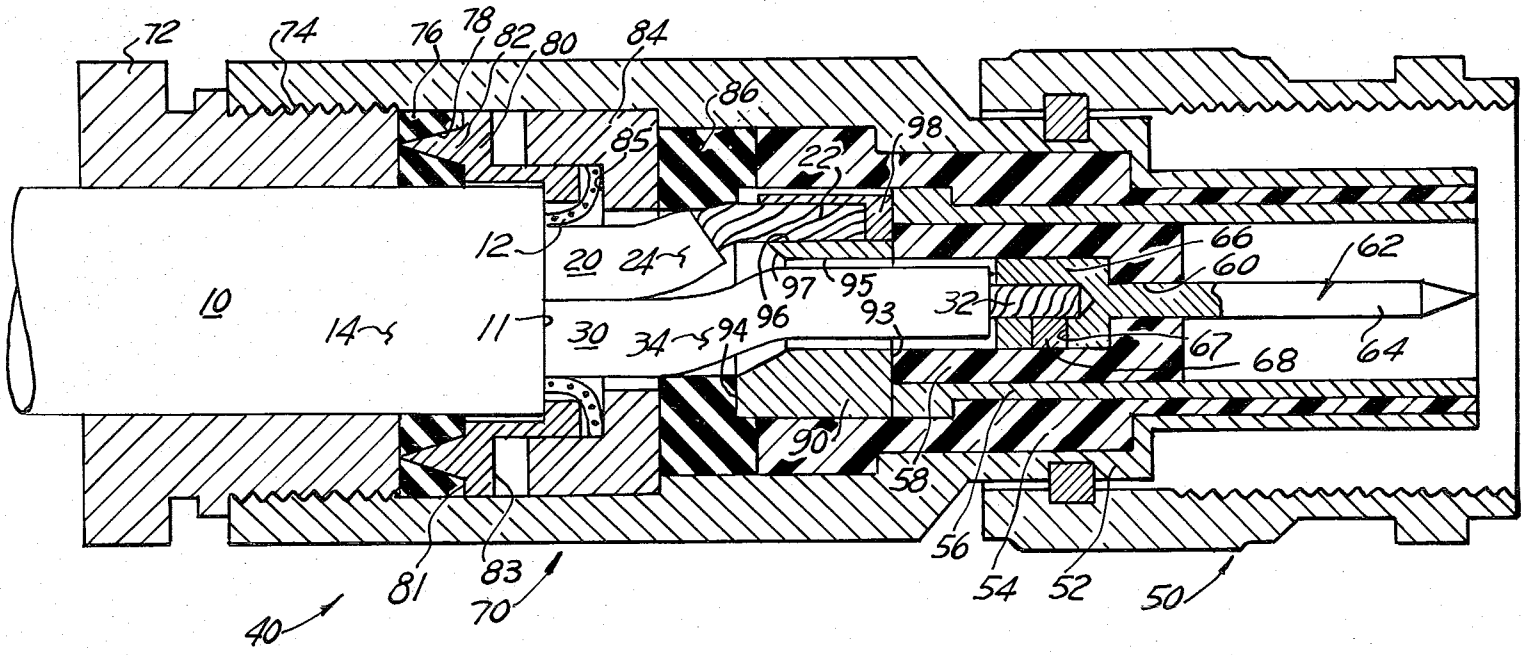
FIG. 2 is a sectional view of a connector assembly according to the present invention.

Turning now to FIG. 2, a plug type connector 40 is shown assembled in electrical circuit relation with a cable 10 of the twinaxial type. The cable 10 is referred to as of the twinaxial type and comprises a pair of insulated inner conductor wires 20, 30 surrounded in common by a woven braid-type outer conductor 12 and by an external sheath jacket 14. Each wire 20, 30 comprises an inner conductor 22, 32 with each inner conductor, respectively, being surrounded by a body of dielectric material 24, 34. The end portion of cable 10 was prepared by trimming off part of the jacket 14 and outer conductor 12 (see FIG. 5) so as to provide the cable end 11 with a square cut and to expose the inner conductors 22,32 by removing part of the wire insulation 24, 34 to provide the inner conductors 22, 32 with unequal axial extensions.

The plug-type connector 40 comprises a first connector member 50, a second connector member 70 adapted to be fitted over the terminable end portion of the cable 10 and to be secured to the first connector member and a conductor locator 90, the first and second connector members 50, 70 holding the locator 90 as well as the center conductors 22, 32 and outer conductor 12 in axially fixed positions relative to one another in the connector 40.

The second connector member 70 assembly is common for both the plug-type connector 40 or a jack-type connector **40*a* (see FIG. 3). The second connector member 70 comprises a nut 72 having a threaded outer surface 74, a first annular gasket 76 of resilient material for moisture sealing having a V-shaped groove 78 on an axial face 77, an annular clamp 80 of conductive material having a pair of oppositely facing exterior abutment faces 81, 83, an inner shoulder 87, and a V-shaped wedge 82 extending from the first abutment face 81, the wedge being sized to be received by the V-shaped groove 78 and adapted to cut the gasket 76 to make continuity with the nut a clamp 84 of conductive material having a first axial face 85 disposed to face the second abutment face 83 of the clamp, the outer braid conductor 12 of the cable being splayed back and anchored between the clamp 84 and the annular clamp 80, and a second annular gasket 86** of resilient material for moisture sealing.

As shown, the first connector member 50 comprises a plug body 52 of conductive material (defining an outer contact), a first sleeve 54 of dielectric material, a second sleeve 56 of conductive material (defining an intermediate contact), a third sleeve 58 of dielectric material having an interior bore 60 (defining a support) and an inner contact 62 of conductive material, the inner contact 62 defining a pin-type contact having a forward end 64 sized to pass through the interior bore 60 of the support sleeve 58 and a rearward end 66 sized to fit within the bore 60, the rearward end 66 of the inner contact 62 being sized to receive and to be terminated with the inner conductor 32. For this purpose, solder 68 is received in an opening 67 included in contact 62. The forward end 64 of pin-type contact 62 is sized to mate with contact **62*a* of a mating jack 40*a* (see FIG. 3**).

FIG. 3 is an exploded assembly view of both the plug-type connector 40 and the jack-type connector **40*a*, each connector 40, 40*a* being adapted for use with the twinaxial cable. As noted, each assembled connector includes the second connector member 70 and conductor locator 90. The jack connector 40*a* comprises a second connector member 50*a* including an inner socket contact 62*a*, an insulator support sleeve 58*a*, an intermediate contact 56*a*, an insulator sleeve 54*a* and an outer mateable body 52*a*. Each (subassembly) connector member respectively is interconnected both electrically and mechanically, each to individual conductors of the twinaxial cable, to the center contact and to the locator member 90**.

Turning to FIG. 4, preferably and in accord with the invention, the conductor locator 90 comprises a cylindrical body 91 of conductive material having an outer surface 92 and axially spaced forward and rearward faces 93, 94, the locator body 91 including a central or coaxial passage 95 extending therethrough between the faces for receiving one of the insulated wires 30 and a keyway or slot 96 for receiving an exposed conductor 22 of the other wire 20. The passage is generally of uniform diameter extending from the forward face 93 rearwardly and includes a generally frusto-conical (radially tapered) wall portion 97 extending inwardly from the rear face 94 forwardly. The slot 96 extends axially along and radially inwardly from the outer surface 92 of the locator body. The intersection of the slot 96 and the frusto-conical wall portion 97 of the passage 95 provides the exposed conductor 22 with a keyway that does not result in stress being placed on the electrical joint (i.e., termination) when the exposed end of conductor 22 is secured within the slot 96 by solder 98. The forward face 93 is adapted to abut against the intermediate contact 56, the conductive members completing an electrical path therebetween.

The passage tapers outwardly with the frusto-conical shape to facilitate entry of the insulated conductor wire 30 at the rear face 94, the locator passage being adapted to locate the exposed conductor 32 within a recess of the center contact **62, 62*a*. The slot 96 receives the other exposed conductor 22 and locates this conductor against the back end of the intermediate contact 56, 56*a*. Dielectric insulation 54, 54*a* spaces the locator so that the outer and intermediate contacts 52, 52*a*; 56, 56*a* do not contact and short the system. Desirably the locator contacts the entire rearward radial face of the intermediate contact 56, 56*a*** so as to provide a continuous conductive path from one cable conductor to the contact.

IN OPERATION

Figure 5:
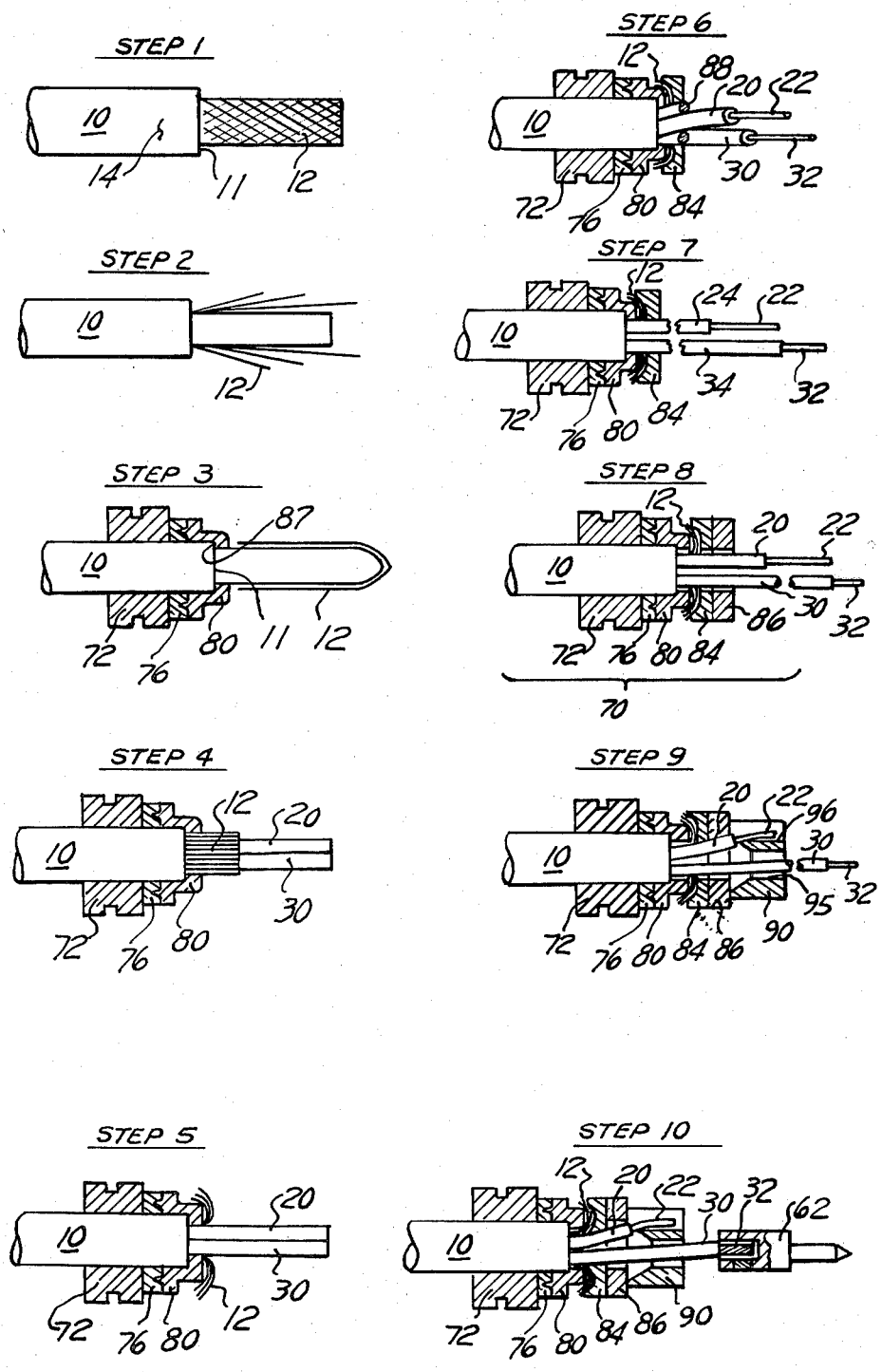
FIG. 5 shows the steps of assembling the plug connector shown in FIG. 2.

Turning now to FIG. 5, a method of assembly is described. In Step 1, a twinaxial cable 10 is prepared by cutting the cable end 11 square and by removing a portion of the protective outer jacket 14, thereby exposing the conductive braid 12. In Steps 2 and 3, the braid 12 is combed-out (axially straightened) and desirably formed into a cone shape, whereupon the nut 72, the gasket 76 and the annular clamp 80 are slid over the cable end such that the inner shoulder 87 of the annular clamp 80 is tightly positioned against the end 11 of cable jacket 14. In Steps 4 and 5, the braid end 12 is axially trimmed to expose the insulated wires 20, 30 and then flared (splayed) back over the annular clamp 80. In Step 6, clamp 84 is positioned over the cable end adjacent the annular clamp to trap the braid therebetween. Fillers 88 that are normally disposed in the twinaxial cable are trimmed flush with the clamp 84. In Step 7, insulation 24, 34 is cut away from each wire 20, 30 with unequal axial extensions from the clamp 84 to thereby expose the inner conductors 22, 32, each inner conductor providing an unequal axial extension from its insulation. In Step 8, gasket 86 is then installed about the prepared end. This provides a first connector subassembly comprising the cable 10 and first connector member 70.

At this point, in Step 9, the conductor locator 90 locates and receives the cable wires in such fashion that one wire 30 (having the shortest axial conductive extension) is fed through the center passage 95 and the other wire 20 is placed adjacent the slot 96 and its inner conductor 22 (having the shortest axial extension) fit into the slot. In Step 10, conductor 22 is terminated into slot 96 by solder 98. Conductor 32 of the wire 30 passed through the locator center passage 95 is then externally secured by solder 67 to an appropriate contact part, either a pin 62 or a socket 62*a*, thereby terminating the other wire.

This connector portion is then assembled to the assembly forming the other connector member. The complete connector assembly is rigidly drawn together by the nut 72. Rotation of nut 72 causes the gaskets 76, 86 to compress for the moisture seal and the V-shaped edge 82 of annular clamp 80 to penetrate and cut through the gasket 76 and to provide a conductive ground path through the connector. The completed electrical connector is shown in FIG. 2.

While a preferred embodiment of this invention has been disclosed, it will be apparent to those skilled in the art, that changes may be made to the invention as set forth in the appended claims, and in some instances, certain features of the invention may be used to advantage without corresponding use of other features. For example, whereas the locator 90 may be advantageously formed of a conductive material, in some instances the body may be other (e.g. non-conductive), the important factor being that the slot provides (straight-in) insertion of one of the inner conductors to expose the conductor 22 to the intermediate conductive contact 56. To this end, for electrical continuity, conductor 22 may be provided with a structure which may be snapped into the slot or the slot may include a conductive preform. Accordingly, it is intended that the illustrative and descriptive materials herein will be used to illustrate the principles of the invention and not to limit the scope thereof.

Having described the invention, what is claimed is:

1. A cable termination apparatus (90) for use in locating and terminating an electrical cable (10) of the twinaxial type to an electrical connector (50), the cable (10) including a pair of insulated wires (20, 30) having inner conductors (22, 32), each of the wires (20, 30) having a forward end portion of its insulation removed to expose its respective inner conductor (22, 32) for termination, said apparatus characterized by:

a generally cylindrical body (91) of conductive material having an outer surface (92) and axially spaced forward and rearward faces (93, 94), said body (91) including a passage (95) extending between the faces for passing one of said wires (30) therethrough whereby the exposed innner conductor (32) thereof is terminated externally of the locator and a slot (96) for receiving the exposed end of the inner conductor (22), said passage (95) including a generally uniform portion extending from the forward face (93) rearwardly and a generally frusto-conical portion (97) extending from the rear face (94) forwardly, said slot (96) extending axially between the faces and radially into the outer surface (92), the slot intersecting with the frusto-conical portion to provide the exposed end of the inner conductor (22) with a stress relief when the exposed end is terminated within the slot.

2. In combination, an electrical connector (40) and a cable (10) terminated to the connector, characterized by:

said cable (10) being of the twinaxial type and comprising first and second insulated wires (20, 30) having inner conductors (22, 32) surrounded by conductive braid (12), each of the inner conductors having its forward end portion exposed for termination;

an inner conductor locator (90) supported in said connector (40), said locator having first and second ends (93, 94), an outer surface (92), a passage (95) extending through the locator and between the ends and a slot (96) of conductive material, said passage (95) passing the second wire (30) through the locator for termination to a first contact (62) and said slot (96) terminating the exposed forward end portion of inner conductor (22) of said second wire (20), including a frusto-conical end portion (97) forming a locating entry for the second wire (30) and which intersects the slot (96); and securing means (50, 70) for holding said inner conductors (22, 32) and said locator (90) in axially fixed positions relative to one another in the connector.

3. An apparatus characterized by a cable (10) having a free end (11) terminated by an electrical connector (40), said cable (10) being of the type including a pair of insulated wires (20, 30) and a common sheath (12) of conductive material circumposed about the wires, each of the wires having, respectively, an inner conductor (22, 32) and each having a forward end portion of its insulation removed and its inner conductor exposed for termination; and said electrical connector (40) comprising a first connector member (50) including contacts (56, 62) of conductive material, a conductor locator (90) for locating each inner conductor (22, 32) with one respective contact and a second connector member (70) secured to the first connector member, said first and second connector members (50, 70) holding the locator (90), the insulated wires (20, 30) and the sheath (12) in axially fixed positions relative to one another in the connector, said locator (90) including a pair of axially spaced faces (93, 94), a passage (95) extending between the faces and a radial slot (96) of conductive material, said passage (95) passing one said wire (30) therethrough and its exposed inner conductor (32) to its termination to one of said contacts (62), said radial slot (96) terminating the exposed inner conductor (22) of the other wire (20) and having an end portion in abutting relation to the other of the contacts (56).

4. An apparatus of the type described in claim 3 wherein said locator (90) is comprised of a conductive material and said locator passage (95) includes a frusto-conical tapered portion (97) that extends inwardly from one face (94) and which intersects said radial slot (96), the tapered portion (97) providing a locating entry for the one wire (30).

* * * * *